US006153075A

United States Patent [19]

Nemelka

[11] Patent Number: 6,153,075

[45] Date of Patent: Nov. 28, 2000

[54] METHODS USING ELECTROPHORETICALLY DEPOSITED PATTERNABLE MATERIAL

[75] Inventor: Jefferson O. Nemelka, Boise, Id.

[73] Assignee: Micron Technology, Inc., Boise, Id.

[21] Appl. No.: 09/031,955

[22] Filed: Feb. 26, 1998

[51] Int. Cl.[7] ..... C25D 13/02

[52] U.S. Cl. ..... 204/485; 204/490

[58] Field of Search ..... 204/485, 490

[56] References Cited

U.S. PATENT DOCUMENTS

| | | | |
|---|---|---|---|
| 3,387,975 | 6/1968 | Tamura | 96/36.1 |
| 4,592,816 | 6/1986 | Emmons et al. | 204/180.6 |
| 4,751,172 | 6/1988 | Rodriguez et al. | 430/314 |
| 4,891,110 | 1/1990 | Libman et al. | 204/181.1 |
| 5,004,672 | 4/1991 | D'Ottavio et al. | 430/314 |
| 5,196,098 | 3/1993 | Rodriguez et al. | 204/180.2 |
| 5,205,770 | 4/1993 | Lowrey et al. | 445/24 |
| 5,232,549 | 8/1993 | Cathey et al. | 456/633 |
| 5,459,480 | 10/1995 | Browning et al. | 345/75 |
| 5,466,358 | 11/1995 | Kiyomiya et al. | 204/490 |
| 5,486,126 | 1/1996 | Cathey et al. | 445/25 |
| 5,503,582 | 4/1996 | Cathey, Jr. et al. | 445/24 |
| 5,588,359 | 12/1996 | Hofmann et al. | 101/128.21 |
| 5,601,751 | 2/1997 | Watkins et al. | 252/301.4 R |
| 5,607,818 | 3/1997 | Akram et al. | 430/311 |
| 5,634,858 | 6/1997 | Stansbury | 228/105 |
| 5,662,831 | 9/1997 | Chadha | 252/301.4 R |
| 5,667,418 | 9/1997 | Fahlen et al. | 445/25 |
| 5,675,212 | 10/1997 | Schmid et al. | 313/422 |
| 5,931,713 | 8/1999 | Watkins et al. | 495/55 |

OTHER PUBLICATIONS

Eagle®2005 Developer, Product pamphlet, Shipley Company, Inc. (1991).

Eagle®2007 Remover, Product pamphlet, Shipley Company, Inc. (1992).

Eagle®2100 ED Photo Resist, Product pamphlet, Shipley Company, Inc. (1992).

Jacob, T., et al., "Liquid Resist Allows land Size Reduction," *Electronic Packaging & Production*, 36, 27–34 (1996).

Miller, P., "Inner–Layer Imaging using a Novel Electrophoretic Resist," Nepcon East 1989 Conference, Boston, MA (1989).

Murray, J., "Ed Processes Revisted," *PC FAB*, 22–23 (1992).

Shmulovich, J., et al., "Successful Development of Non–Planar Lithography for Micro–Machining Applications," *Integrated Photonics Research*, 6, 354–357 (1996).

Vidusek, D., "Electrophoretic Photoresist Technology: An Image of the Future—Today," *Circuit World*, 15, 6–10 (1989).

*Primary Examiner*—Kishor Mayekar

*Attorney, Agent, or Firm*—Mueting, Raasch & Gebhardt, P.A.

[57] ABSTRACT

Methods for use in the production of a display include providing a substrate assembly of a face plate of the display including a conductive surface at a first side thereof. One or more projections extend from the first side of substrate assembly. A patternable material, e.g., electrophoretically depositable resist, is electrophoretically deposited on at least the conductive surface and adjacent the projections, e.g., spacers such as nonconductive spacers or spacers that have at least portions thereof that are slightly conductive. The method may further include patterning the patternable material for use in deposition of light emitting elements on the conductive surface. Light emitting elements of one or more colors may be formed. In addition, the substrate assembly including the conductive surface may have one or more nonconductive regions formed on the conductive surface; the one or more nonconductive regions having a predetermined thickness. A layer of patternable material is formed by electrophoresis over the conductive surface and over the one or more nonconductive regions. Such patternable material may then be patterned and used in formation of light emitting elements. Further, structures used in the production of a face plate of a display are also provided.

21 Claims, 12 Drawing Sheets

METHODS USING ELECTROPHORETICALLY DEPOSITED PATTERNABLE MATERIAL

FIELD OF THE INVENTION

The present invention relates to the use of electrophoretically deposited patternable material, e.g., photoresist. More particularly, the present invention pertains to the use of electrophoretically deposited patternable material on surfaces with structures thereon such as spacers used in flat panel displays.

BACKGROUND OF THE INVENTION

Displays take many different configurations. In many displays (e.g., flat panel displays, field emission displays) it is required that photoresist be deposited on surfaces having structures projecting therefrom, e.g., spacers on a face plate surface of a flat panel display. Such structures projecting from the surfaces reduce the effectiveness of conventional photoresist application methods used in the formation of features on the surfaces, e.g., photoresist used for patterning phosphors on face plate surfaces.

For example, as described in U.S. Pat. No. 5,486,126, entitled "Spacers For Large Area Displays," issued Jan. 23, 1996, and assigned to Micron Display Technology, Inc., flat panel displays include a cathode emitting structure and a corresponding anode display structure for use in displaying one or more color images on the display. In such field emission devices, there is a relatively high voltage differential between the cathode emitting structure (also referred to as base electrode, base plate, emitter surface, cathode surface, etc.) and the anode display structure (also referred to as an anode, cathodoluminescent screen, display screen, face plate, or display electrode). As indicated in U.S. Pat. No. 5,486,126, it is important that electrical breakdown between the electron cathode emitting structure, i.e., base plate, and the anode display structure, i.e., face plate, be prevented. At the same time, however, narrow spacing between the base plate and face plate is necessary to maintain a desired structurally thin display and to obtain high image resolution. To provide for such narrow spacing, it is required that various features, e.g., spacers, exist between the base plate and face plate of the display.

Spacers incorporated between the display face plate and base plate have certain characteristics. For example, such spacer structures are generally nonconductive to prevent electrical breakdown between the face plate and base plate in spite of the relatively close spacing therebetween and relatively high voltage differential, e.g., 300 or more volts. However, such spacer structures may have portions that are conductive.

The spacers may include pillars as described in U.S. Pat. No. 5,486,126; support structure as described in U.S. Pat. No. 5,667,418 entitled "Method Of Fabricating Flat Panel Device Having Internal Support Structure," issued Sep. 16, 1997; spacer structure as described in U.S. Pat. No. 5,675,212 entitled "Spacer Structure For Use In Flat Panel Displays And Methods For Forming Same," issued Oct. 7, 1997; spacers as described in U.S. Pat. No. 5,634,585 entitled "Method For Aligning And Assembling Spaced Components," issued Jun. 3, 1997; U.S. Pat. No. 5,503,582 entitled "Method For Forming Spacers For Display Devices Employing Reduced Pressures," issued Apr. 2, 1996; U.S. Pat. No. 5,232,549 entitled "Spacers For Field Emission Display Fabricated Via Self-Aligned High Energy Ablation," issued Aug. 3, 1993; and U.S. Pat. No. 5,205,770 entitled "Method To Form High Aspect Ratio Supports (Spacers) For Field Emission Display Using Micro-saw Technology," issued Apr. 27, 1993; or any other spacer configuration, such as a screen printed feature, a stencil printed feature, glass spheres, etc.

Such spacers are fixed in one manner or another to either the face plate or the base plate. In many circumstances, such as when processes involved in making the base plate prevent the adhesion of spacers thereto or when such processes may weaken or damage the spacers, it is required that such spacers be attached or otherwise affixed to the face plate. Further, when the light emitting material, e.g., phosphors, impedes the adhesion of the spacers to the face plate, the spacers must be attached to the face plate prior to the phosphors being formed thereon. For example, U.S. Pat. No. 5,486,126 describes a method of disposing micropillar spacers on a surface of the face plate of a display.

Phosphors deposited on the surface of the face plate emit energy when excited by electrons. Phosphors are normally composed of inorganic luminescent materials that absorb incident radiation and subsequently emit radiation within the visible region of the spectrum. Phosphors are preferably capable of maintaining luminescence (e.g., fluorescence) under excitation for a relatively long period of time to provide superior image reproduction. Various phosphors include, for example, $Y_2O_3$:Eu, ZnS:Ag, $Zn_2SiO_4$:Mn, ZnO:Zn, or other doped rare earth metal oxides.

Affixation of the spacers to the face plate structure of a display prior to deposition of phosphors thereon presents problems in the deposition and patterning of such phosphors. Such problems result at least in part from the lack of ability to provide a uniform layer of patternable material in the regions between the spacers and, in particular, in areas directly adjacent to the spacers. A uniform layer of patternable material is necessary so that photolithographic processes can be effectively performed, as is done using phosphor slurries to make CRT screens, e.g., as described in U.S. Pat. No. 3,387,975 entitled "Method Of Making Color Screen Of A Cathode Ray Tube," issued Mar. 10, 1965.

For example, if the face plate having the spacers projecting therefrom is coated with a patternable material, e.g., resist, by spin coating, areas of noncoating or minimal coating may occur on the face plate adjacent the spacers as a result of such spacers blocking the flow of the patternable material. The patternable material also tends to form a meniscus with the spacers, resulting in a layer that is generally too thick and very non-uniform, particularly in regions adjacent to the spacers. Similar problems occur with meniscus, dip, or spray coating techniques.

Electrophoretic photoresist technology has been described in various articles and patents. For example, the article by D.A. Vidusek, entitled "Electrophoretic Photoresist Technology: An Image of the Future—Today," presented in December 1988 at the EIPC Winter Conference in Zurich, Switzerland, describes electrophoresis as a new technique for applying photoresist. Further, such electrophoretic deposition processes and photoresist for use in such processes are described in U.S. Pat. No. 4,592,816, entitled "Electrophoretic Deposition Process," issued Jun. 3, 1986; U.S. Pat. No. 4,751,172, entitled "Process For Forming Metal Images," issued Jun. 14, 1988; U.S. Pat. No. 5,004,672, entitled "Electrophoretic Method for Applying Photoresist to Three-Dimensional Circuit Board Substrate," issued Apr. 2, 1991; U.S. Pat. No. 5,196,098, entitled "Apparatus and Process for Electrophoretic Deposition," issued Mar. 23, 1993; and U.S. Pat. No. 5,607,818 entitled "Method For Making Interconnects And Semiconductor Structures Using Electrophoretic Photoresist Deposition," issued Mar. 4, 1997.

SUMMARY OF THE INVENTION

To overcome the problems described above, and others which will be apparent from the detailed description below, a patternable material is electrophoretically deposited to give uniform resist thicknesses on surfaces having features, e.g., spacers, projecting therefrom, such as are common to many flat panel display face plates. The electrophoretically deposited patternable material may then be used for forming various structures such as light emitting elements relative to the face plate, e.g., color patterning for a color display.

A method for use in the production of a face plate of a display according to the present invention includes providing a substrate assembly of the display face plate with the substrate assembly including a conductive surface at a first side of the assembly. One or more projections extend from the first side of the substrate assembly. A patternable material, e.g., electrophoretically depositable resist, is electrophoretically deposited on the conductive surface and adjacent the projections.

In various embodiments of the method, the one or more projections include a plurality of spacers extending from the first side of the substrate assembly. The spacers may be nonconductive or have at least portions thereof that are slightly conductive.

In another embodiment of the method, patterning of the patternable material results in a first patterned layer defining openings to the conductive surface for use in deposition of one or more light emitting elements on the conductive surface. Further, the method may include forming one or more first color light emitting elements on the conductive surface through the defined openings in the first patterned layer. The first patterned layer is then removed after the one or more first color light emitting elements are formed resulting in exposed regions of the conductive surface. Yet further, the electrophoretic deposition and patterning of patternable material and the forming of light emitting elements on the conductive surface may be repeated to form additional light emitting elements of one or more additional colors on the conductive surface.

In yet another embodiment of the method, the electrophoretic deposition of the patternable material over the conductive surface and adjacent the projections may include electrophoretically depositing a patternable material mixed with a light emitting material over the conductive surface and adjacent the projections.

In yet further another embodiment, the method may include patterning the patternable material by tackifying one or more surface regions of the deposited patternable material for use in depositing the light emitting material.

Another method for use in the production of a display according to the present invention includes providing a substrate assembly including a conductive surface and providing one or more nonconductive regions formed on the conductive surface. The one or more nonconductive regions have a thickness less than about 15 microns. A layer of patternable material is formed by electrophoresis over the conductive surface and the one or more nonconductive regions.

In various embodiments of the method, the one or more nonconductive regions may include one or more nonconductive light emitting elements, e.g., phosphors and/or the one or more nonconductive regions may include a nonconductive black matrix. Further, the method may include patterning the patternable material resulting in a patterned layer defining openings to the conductive surface for use in formation of light emitting elements on the conductive surface.

A method for use in producing a display having a face plate and a base plate according to the present invention is also described. The face plate has one or more spacers extending from one side thereof for spacing the face plate from the base plate in the display. The method includes electrophoretically depositing a patternable material over a conductive surface of the face plate in regions adjacent one or more of the spacers, patterning the patternable material resulting in a patterned layer defining openings to the conductive surface, and forming a material on the conductive surface through the defined openings. The patterned layer is then removed.

Yet another method according to the present invention is described for use in the production of a color display to deposit a pattern of light emitting elements capable of emitting light of at least two different colors when excited. The display includes a face plate having a plurality of spacers extending from one side thereof for use in spacing the face plate from a base plate of the color display. The method includes providing a face plate substrate assembly from which the spacers extend.

A conductive surface is exposed in regions between the plurality of spacers. An electrophoretically deposited patternable material is used to form the pattern of light emitting elements on the conductive surface. The light emitting elements may be formed in a number of ways. For example, the elements may be formed using electrophoretic deposition of a light emitting material after patterning an electrophoretically deposited patternable layer or may be formed by patterning a deposited layer of a mixture of patternable material and light emitting material. Further, the light emitting elements may be formed by tackification of the patternable layer followed by dusting with the light emitting material.

A structure used in the production of a face plate of a display according to the present invention includes a substrate assembly having a conductive surface at a first side thereof. One or more projections extend from the first side of the substrate assembly and an electrophoretically deposited patternable material is formed on the conductive surface and adjacent the projections.

In various embodiments of the structure, the one or more projections may include a plurality of nonconductive spacers extending from the first side of the substrate assembly. The one or more projections may include spacers having at least portions that are slightly conductive extending from the first side of the substrate assembly, and the patternable material may define openings to the conductive surface for use in deposition of one or more light emitting elements on the conductive surface.

Another structure used in the production of a display according to the present invention includes a substrate assembly with a conductive surface. One or more nonconductive regions are formed on the conductive surface. The one or more nonconductive regions have a thickness less than about 15 microns. Electrophoretically deposited patternable material is formed over the conductive surface and the one or more nonconductive regions.

In various embodiments of this structure, the one or more projections may extend from the substrate assembly beyond the nonconductive regions formed on the conductive surface, the one or more nonconductive regions may include one or more phosphor light emitting elements and/or may include black matrix material, and the patternable material may define openings to the conductive surface for use in formation of light emitting elements on the conductive surface.

BRIEF DESCRIPTION OF THE DRAWINGS

The present invention will be better understood from reading the following description of illustrative embodiments with reference to the attached drawings, wherein below.

DETAILED DESCRIPTION OF THE EMBODIMENTS

Figure 1A:
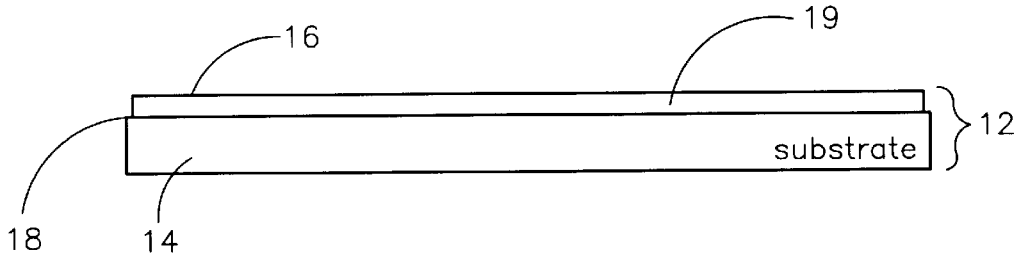
FIGS. 1A–IF illustrate the use of electrophoretically deposited patternable material on substrate assemblies having spacers or other features extending therefrom according to the present invention.
Figure 1B:
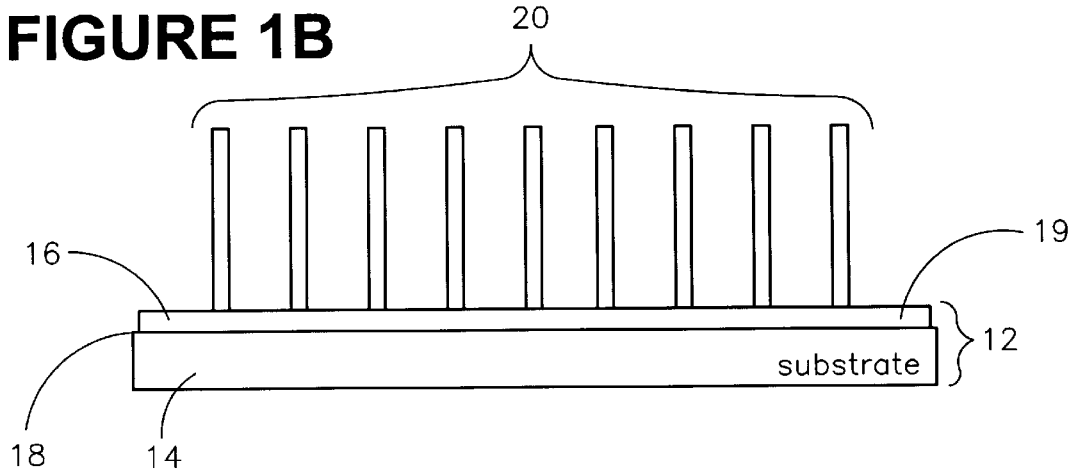
Figure 1C:
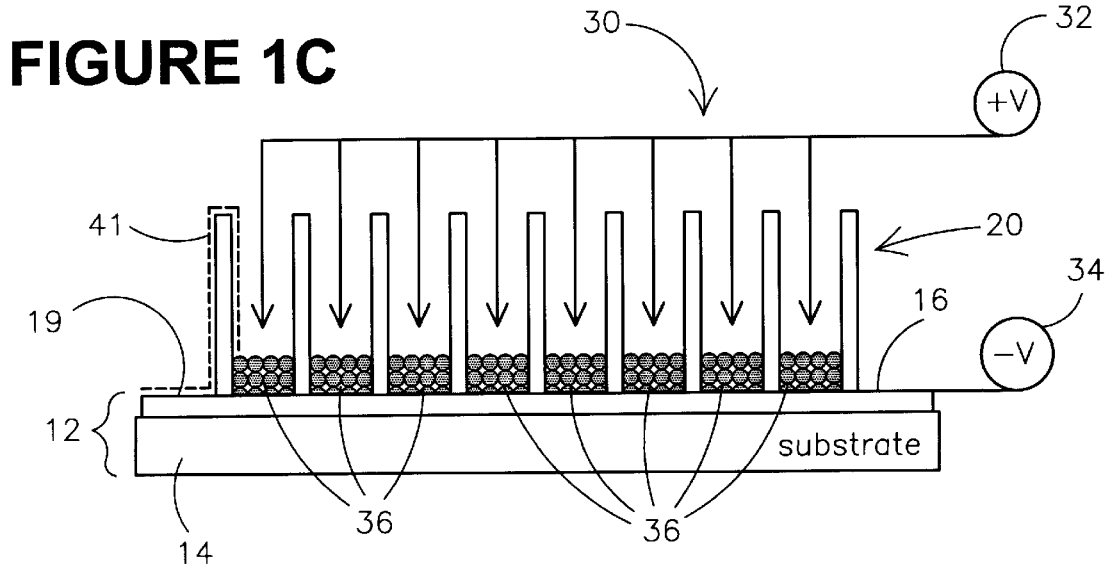
Figure 1D:
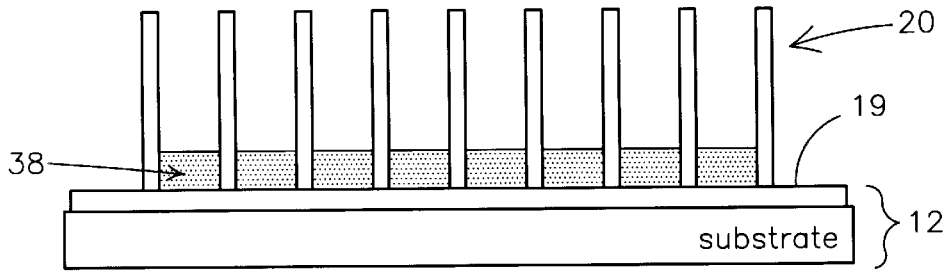
Figure 1E:
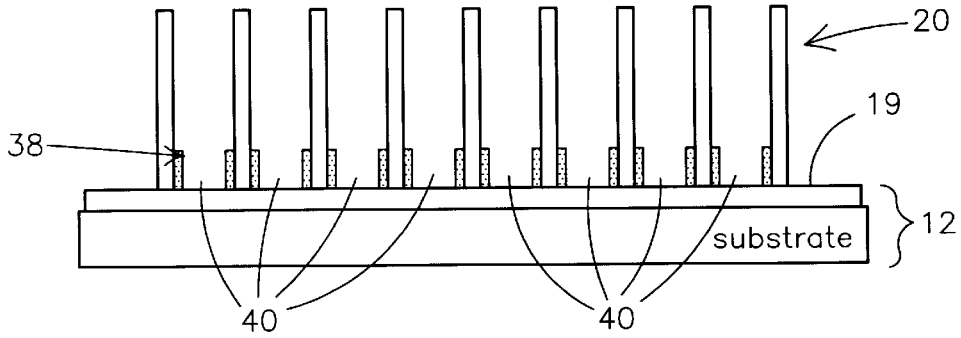
Figure 1F:
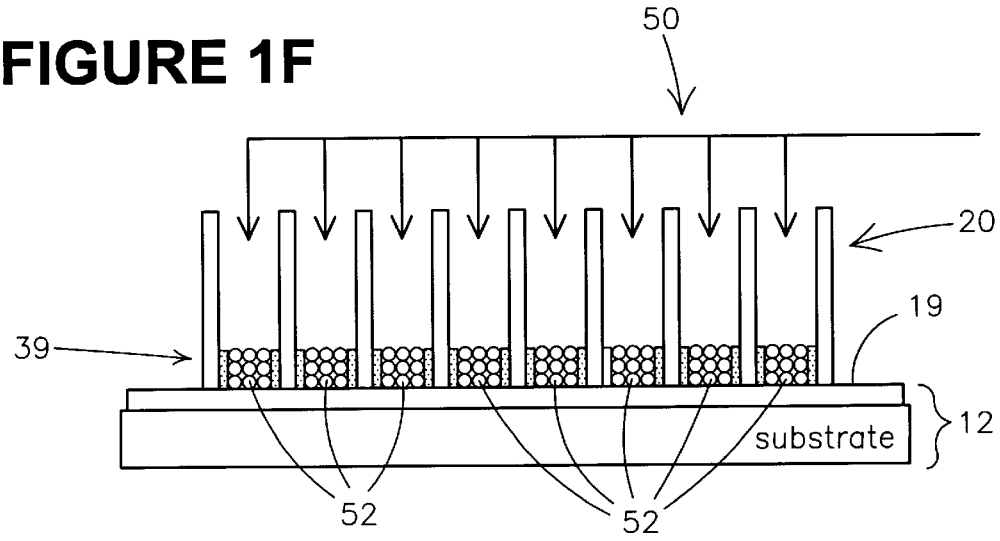
Figure 2:
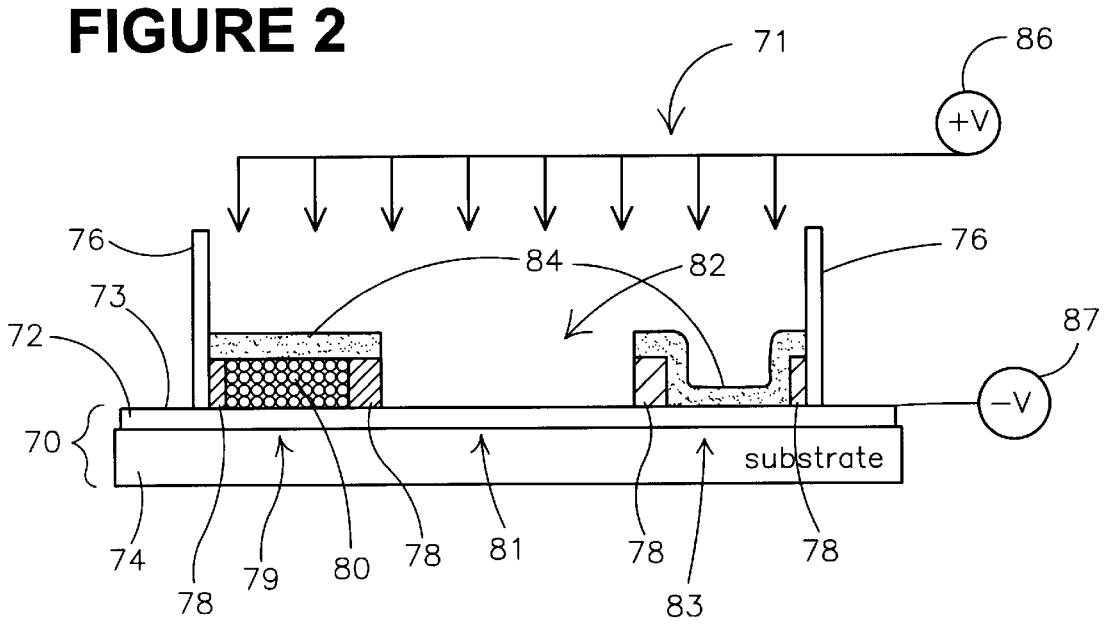
FIG. 2 is a general illustration of electrophoretically depositing patternable material over a conductive surface and nonconductive regions formed on the conductive surface between spacers projecting therefrom.

The present invention shall be described generally with reference to FIGS. 1–2. Thereafter, various embodiments and illustrations related to and/or associated with using electrophoretically deposited patternable material in accordance with the present invention shall be described with reference to FIGS. 1–8.

Although the present invention is particularly described with reference to the formation of a face plate assembly having projections extending therefrom for a display, e.g., a field emission display, a flat panel display, etc., the present invention is not limited to the use of electrophoretically deposited patternable material for such illustrative purposes. Rather, the present invention is limited only in accordance with the accompanying claims. As will be described further herein, the present invention uses the electrophoretic deposition of patternable material in various circumstances including, but not limited to, electrophoretic deposition of material on conductive surfaces and relatively thin regions of nonconductive material formed on such conductive surfaces, on conductive surfaces of substrate assemblies adjacent nonconductive projections extending from such substrate assemblies, on conductive surfaces of substrate assemblies and on slightly conductive projections or slightly conductive portions of such projections, and/or combinations thereof.

FIGS. 1A–1F illustrate the use of electrophoretically depositing patternable material 36 on a substrate assembly 12 having projections 20 extending therefrom. The substrate assembly 12 includes a conductive layer or coating 16 on a substrate material 14. The patternable material 36 can be patterned for use in forming structures (e.g., phosphor elements, black matrix regions, etc.) on a conductive surface 19 of the substrate assembly 12. For example, in the case of a face plate assembly for a field emission display, the substrate assembly 12 includes a conductive layer 16 formed of a metal or other electrically conductive composition which functions as the electrode during the electrophoretic deposition of patternable material (e.g., photoresist) and/or electrophoretic formation of phosphors on the conductive surface 19.

Preferably, the conductive layer 16 is an electrically conductive material that is suitably transparent such that the material does not need to be removed for allowing light emission from light emitting elements, e.g., phosphors, formed on the conductive coating 16. For example, the transparent conductive material may be indium tin oxide or some other suitable transparent conductive material. In the case of a display, the substrate layer 14 may be any transparent material, such as glass.

Further, when substrate assembly 12 is part of a face plate of a display, an optional black matrix material 18 may be patterned between the conductive layer 16 and substrate 14. For example, such a black matrix layer may be a light absorptive, black surround material which is preferably nonconductive and may be manganese carbonate, cobalt oxide black, or other iron oxides with cobalt oxides. It will be readily apparent to one skilled in the art that this black matrix material 18 may be deposited using electrophoretically deposited photoresist and patterning processes similar to those described herein. Further, it will be readily apparent that the black matrix material 18 may optionally be formed after the conductive coating 16 is formed on a substrate 14 as opposed to before the conductive coating 16 is formed. For example, in such a case, the black matrix material may be formed in a manner similar to how a light emitting element is formed on the conductive surface 19 of conductive layer 16 from which projections or spacers 20 extend, as described further below. The black matrix material may also be formed using various thin film coating methods, e.g., sputtering or chemical vapor deposition.

FIG. 1B shows the substrate assembly 12 of FIG. 1A, further including projections 20. Projections 20 may include features of any size, shape, configuration, or pattern of material. For example, as described in U.S. Pat. No. 5,486,126, the features 20 may be spacers configured as micropillars of glass containing material. It will be readily apparent to one skilled in the art that such features 20 may include various other structures extending from substrate assembly 12, including posts, pillars, glass spheres, or any other type of feature which provides a spacer function in a display (such as the spacers described in the Background of the Invention section), or any other function necessary for other applications as would be recognized by one skilled in the art.

Preferably, in the case of a face plate assembly, the features 20 include spacers that are posts or pillars extending substantially orthogonally from the substrate assembly 12, as described in U.S. Pat. No. 5,486,126. Such spacers may be attached to conductive surface 19 of substrate assembly 12 or other portions of the substrate assembly 12. As described in the Background of the Invention section, the spacer structures for FED displays generally are nonconductive to prevent electrical breakdown between cathode and anode structures in the display, exhibit mechanical strength to prevent the display from collapsing under atmospheric pressure, and be small enough so as not to visibly interfere with display operation. As used herein, nonconductive refers to structures having a surface resistivity of greater than about $10^{12}$ ohms-cm.

The spacers may also be slightly conductive or have portions that are slightly conductive for use in bleeding away excess charge caused by stray electrons impacting on the surface of the spacers. As used herein, slightly conductive refers to a surface resistivity in the range of about $10^7$ ohms-cm to about $10^{12}$ ohms-cm. For example, in a field emission display, the electron emitting structures emit beams of electrons which are generally cone shaped. The cone shape may cause some electrons to impact on the sides of the spacers instead of on the face plate towards which they are directed. When this occurs, charge is built up on the surface of the spacers which increases the likelihood of electrical breakdown. With the spacer being slightly conductive or having portions that are slightly conductive, the charge built up can be reduced and the charge can be bled away through a conductive layer on the face plate.

Therefore, generally, and in accordance with the description above, substrate assembly 12 may include any substrate assembly having a conductive surface with projections, e.g., spacers, features, etc., extending from one side of the substrate assembly. The side from which the projections extend is the same side of the substrate assembly 12 that includes conductive surface 19. The substrate assembly may include any number of layers and/or structures and be of various shapes, sizes, etc. For example, the substrate assembly may have a slightly curved shape. Generally, the spacers or features 20 have a length that is greater than the desired thickness of electrophoretically deposited patternable material, as described below, to be deposited on the conductive surface 19 of conductive layer 16.

Figure 7:
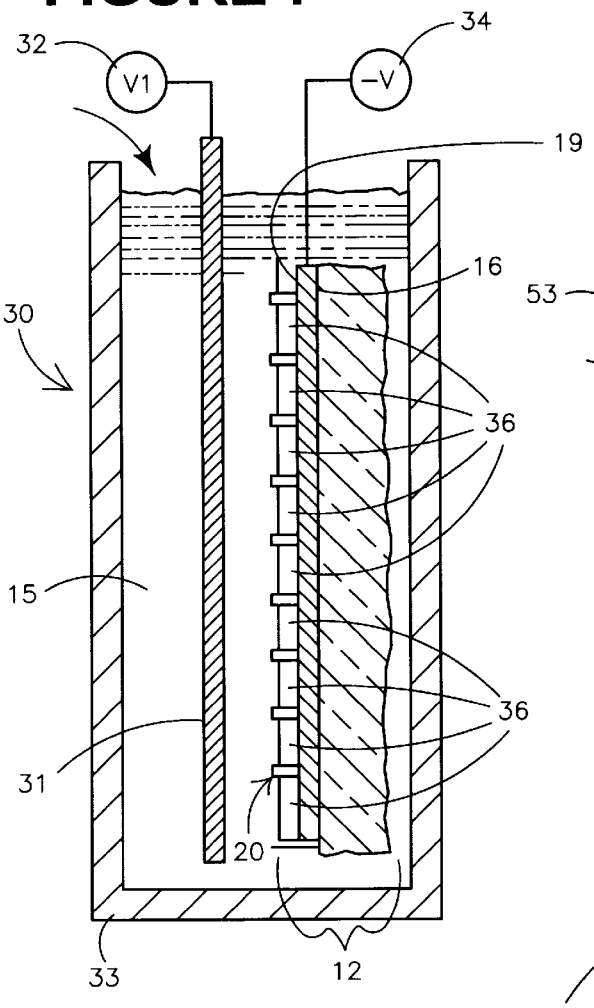
FIG. 7 is one illustration of an emulsion tank for use in electrophoretically depositing a patternable material in accordance with the present invention.
Figure 8:
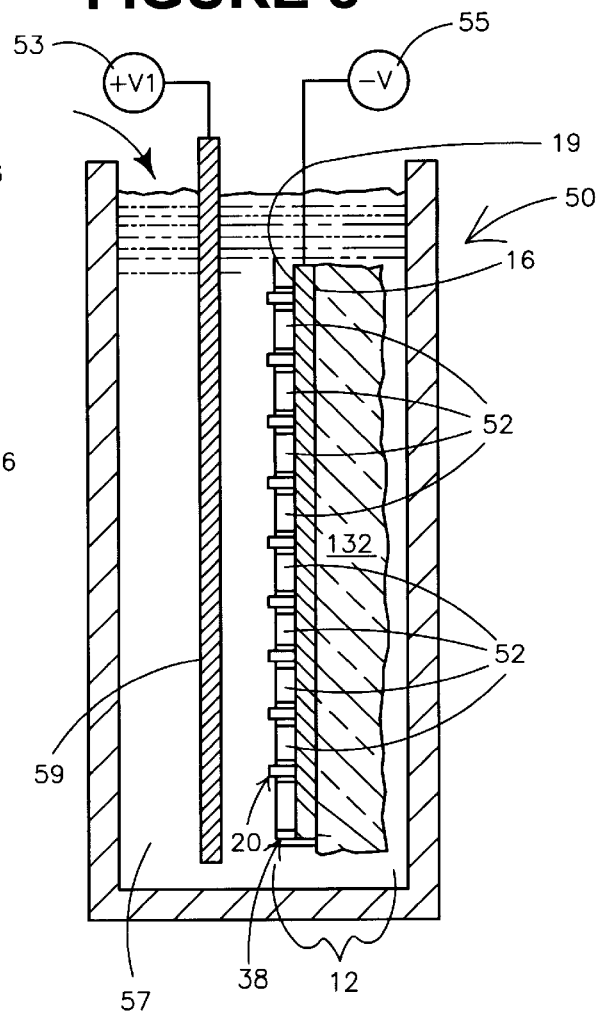
FIG. 8 is one illustration of an emulsion tank for electrophoretically depositing phosphors.

FIG. 1C shows the substrate assembly 12 of FIG. 1B including conductive surface 19 at a first side of the substrate assembly 12 with the one or more projections 20 extending from the same side of the substrate assembly as the conductive surface 19. In addition to the substrate assembly 12, FIG. 1C generally illustrates an electrophoretic deposition system 30 used to electrophoretically form a uniform patternable material layer on surface 19 adjacent to projections 20 extending from substrate assembly 12. One illustrative embodiment of a portion of such a system 30 is shown in FIG. 7.

The electrophoretic deposition of the patternable material is simply defined as the migration of charged particles in suspension under the influence of an electric field. In other words, the patternable material is deposited on the conductive surface 19 using an aqueous emulsion solution 15, as shown in FIG. 7, under the influence of a voltage differential applied via voltage 32 applied to an electrode 31 and voltage 34 applied to the conductive layer 16. The electrophoretic deposition of the patternable material is described in numerous references, including the article, "Electrophoretic Photoresist Technology: An Image of the Future—Today," by D. A. Vidusek of the Shipley Company, Inc., Newton, Massachusetts, U.S.A.; the article entitled, "Inner-layer Imaging Using a Novel Electrophoretic Resist," by Philip J. Miller, Jr., Shipley Company, Inc., Newton, Mass., presented in the Proceedings of the Technical Program of the National Electronic Packaging and Production Conference (NEPCON EAST '89), Boston, Mass. (Jun. 12–15, 1989); and in U.S. Pat. Nos. 4,751,172; 5,004,672; 5,196,098; and 4,592,816.

Generally, prior to the electrophoretic deposition, a precleaning process is performed to clean the deposition surface, e.g., conductive surface 19. The precleaning may be performed using ultrasonication or by condensation of hot solvent vapors, such as methanol, onto the surface. After the conductive surface 19 is cleaned, it is positioned into an emulsion tank where the patternable material 36 is electrophoretically deposited on the conductive surface 19 adjacent and between the projections 20. The patternable material 36 may be any electrodepositable resist material such as, for example, those available under the trade designation Eagle® 2100 ED photoresist available from Shipley Company, Inc. (Newton, Mass.); a resist previously available from DuPont Electronics (Wilmington, Del.) under the trade designation Prime Coat; and/or an electrophoretic resist material previously available from MacDermid, Inc. (Waterbury, Conn.) under the trade designation Electro Image. It will be apparent to one skilled in the art that the process parameters used to electrodeposit the patternable material will vary depending upon the patternable material used. The following description of the deposition process includes parameters preferably applicable to the resist, Eagle® 2100 ED, but which are believed to be generally applicable to the deposition of most electrodepositable resists or patternable materials.

As described in the articles listed above, generally, for the electrophoretic deposition of a dry film photoresist from an aqueous emulsion solution, the photoresist bath is in the range of 10% solids. The solids are in the form of micelles (i.e., stable, charged organic particles suspended in the water of the bath). Within each micelle is the polymer (e.g., a suitable monomer for cross-linking, photo initiators, visual contrast enhancing dye, etc.). The polymer provides the surface charge necessary for stabilization in water solution. The polymer is generally a copolymer of acrylate, methacrylate, and amino acrylate. In the presence of an acid, the amino group of the polymer becomes positively charged, giving the polymer a net charge that causes it to migrate in an electric field established by the voltage differential applied by voltages 32, 34.

Upon application of the voltage differential, the photoresist micelles begin to migrate within the solution 15. The resist is cathodic in that it migrates to the cathode or negative electrode. Upon reaching the cathodic substrate (e.g., conductive surface 19), the positively charged carrier groups (e.g., the protonated amine groups of the polymer) are neutralized by the hydroxide ions generated at the cathode from reduction of $H_2O$ and the organic material is formed on the surface 19.

As shown in FIG. 1C and FIG. 7, the substrate assembly 12 having spacers 20 thereon is positioned in tank or bath housing 33. The electric field in the electrophoretic deposition system 30 is applied using a positive voltage 32 applied to electrode 31 positioned in the emulsion 15 within tank housing 33 and a negative voltage 34 is applied to the conductive layer 16 of the substrate assembly 12. With the substrate assembly 12 having the projections 20 extending therefrom positioned in the emulsion 15 in a manner preferably substantially parallel to the plane of electrode 31 (e.g., a plate electrode), resist migrates to the conductive surface 19 and deposits thereon. The applied voltage 32 is preferably in the range of about +10 volts to about +300 volts, and the voltage 34 applied is preferably in the range of about −10 volts to about −300 volts. However, one skilled in the art will recognize that the voltage differential applied between the electrode 31 and conductive layer 16 of the substrate assembly 12 may vary, in addition to the varying of other parameters, to accomplish the desired thickness of resist deposited. The thickness of the patternable material 36 deposited can also be controlled by the temperature of emulsion 15 in tank housing 33. Preferably, the thickness of the patternable material 36 is in the range of about 1 micron to about 15 microns for use in depositing or forming phosphor elements, as further described below.

After electrophoretic deposition of the patternable material 36, the substrate assembly 12 is removed from the emulsion tank housing 33, then rinsed and dried. The patternable material 36 coalesces (i.e., the agglomeration of resist material is compacted into a uniform layer) upon application of heat to form a uniform patternable layer 38 of patternable material 36 on conductive surface 19 adjacent and between projections 20. Preferably, the coated substrates are heated, for example, in an oven or on a hotplate at a temperature of about 50° C. to about 120° C. for about 5 seconds to about 30 minutes to dry the resist film forming the uniform patternable layer 38. When deposited, the patternable material is substantially the same thickness adjacent the projections 20 as on other regions of the conductive surface 19 or at least within a deviation of 1 percent to about 10 percent. Upon coalescing the material, a slight meniscus is formed with the spacers, causing the deviation to increase to about 10 percent to about 75 percent, depending upon the temperature used for coalescing the patternable material. In general, lower temperatures are preferred to maintain uniformity adjacent to the projections 20.

As previously indicated, it will be readily apparent to one skilled in the art that the electrophoretic deposition process will be different dependent upon the patternable material being used and the system used to perform such deposition. Various components may be used with the tank housing to perform the electrophoretic deposition process. For example, such components are described in the articles referenced herein and include, but clearly are not limited to, filtration components, heaters, additional baths or other methods to rinse excess resist from the coated substrate prior to coalescence, particle filters to remove contamination of the emulsion bath, overflow networks, agitators, vibratory equipment, and dryers. For example, the removal of excess water from the coated substrate assembly may include the use of a dry hot nitrogen tank, an air knife technique, a nitrogen gas spray assembly, a spin dry technique or by evaporation techniques, as are known to those skilled in the art.

In one illustrative example of the deposition of the patternable material 36, the substrate assembly 12 with projections 20 thereon is placed in the bath housing 33. The emulsion includes about 10% solids and is held at a constant temperature of 40° C. while a voltage differential of about 50 volts is applied between electrode 31 and the conductive surface 19 for about 1 minute. The coated substrate assembly is then rinsed in water for about 1 minute to remove excess patternable material. Excess water is then removed by applying a gentle flow of air over the substrate assembly while the water evaporates. Once dry, the patternable layer 38 is coalesced by heating to about 100° C. for about 10 seconds.

After the patternable layer 38 is formed on conductive surface 19, the layer 38 is patterned as shown in FIG. 1E. Such patterning results in patterned layer 39 defining openings 40 open to the conductive surface 19. The layer 38 of patternable material is patterned by exposure through a photomask and development using a suitable developer. For example, exposure to a 340–400 nanometer light source at approximately 200 mJ/cm$^2$ to about 500 mJ/cm$^2$ may be used to expose the layer of patternable material 38 and thereafter a developer compatible and suitable for developing the layer of patternable material 38 is used to remove patternable material, e.g., remove unexposed material if a negative photoresist is used. For illustration, with use of Eagle® 2100 ED photoresist, available from Shipley Company, Inc., and exposed as described thereby, the Eagle® 2005 developer can be used. Such exposure and developing parameters are generally fully described in the literature furnished by the manufacturer of the resist material. Such literature also generally sets forth specific parameters and/or parameter ranges for the electrophoretic deposition of the resist.

With the openings 40 defined by the patterned layer 39, further material 52 may be formed in the openings 40 and on conductive surface 19, as shown in FIG. 1F. For example, such material may include light emitting materials, e.g., phosphor compositions, black matrix materials as previously described herein, or any other material which may be deposited or formed in the openings 40 by any method or technique known to one skilled in the art.

Preferably, in accordance with the present invention, the material formed in openings 40 is a light emitting material for displays, e.g., a phosphor composition. The reference numeral 50 is generally representative of a phosphor formation process. For example, the phosphor composition may be deposited into the patterned openings 40 defined by the patterned layer 39 with use of an electrophoretic bath technique, such as described in U.S. Pat. No. 4,891,110, entitled "Cataphoretic Process For Screening Color Cathode Ray Tubes," issued Jan. 2, 1990.

If the projections 20 are non-conductive, patternable material will not form thereon during the electrophoretic deposition of such material. Further, if phosphors are electrophoretically deposited on the conductive surface, such phosphors will not deposit on the nonconductive projections.

If the projections 20 are slightly conductive for purposes previously mentioned, the patternable layer 38 being electrophoretically formed on conductive surface 19 will also be formed on the slightly conductive projections 20 or slightly conductive portions thereof as represented generally in a portion of FIG. 1C as dashed line 41. Obviously, the patternable material would form over all the slightly conductive portions. The patternable layer 38 is sufficiently nonconductive so as to prevent phosphor adhesion on parts of the substrate assembly covered by the patternable layer and particularly on the slightly conductive projections 20 or slightly conductive portions thereof. This minimizes stray deposits of phosphors (e.g., such as on the projections) which may create impurities and alter the color images of the display. Such alterations may occur if stray deposits of phosphors on projections 20 are excited by stray electrons, causing unwanted emission of visible light.

It will be recognized by one skilled in the art that the phosphor formation process 50 may be any known method of depositing or forming phosphor elements in the openings 40, and that the present invention is not limited to any particular method or technique. Commonly used methods for depositing phosphors or light emitting material include electrophoresis, settling techniques, slurry methods (such as screen printing, spin coating, and spin casting), or dusting methods (such as electrostatic dusting and "phototacky" methods). Several such methods will be described further below.

One method for producing deposits of phosphors 52 is electrophoresis (i.e., electrophoretic deposition), such as known to one skilled in the art, for example, as described in U.S. Pat. No. 4,891,110 and/or generally illustrated in FIG. 8. In electrophoresis, phosphor particles are deposited from a suspension 57 under the action of an electric field (set up by voltage 53 applied to electrode 59 and voltage 55 applied to conductive layer 16). The suspension typically includes a nonaqueous liquid, such as an alcohol, and an electrolyte, such as a salt of yttrium, cerium, indium, aluminum, lanthanum, magnesium, zinc, or thorium. Upon dissociation, the metal ions adsorb onto and positively charge the phosphor particles which alone have either positive or negative charges. The deposition surface, e.g., portions of conductive surface 19, typically serve as the cathode (cataphoresis). An electrochemical reaction occurs at the cathode, believed to convert metal salts to metal hydroxides, thus assisting in phosphor deposition and/or adhesion.

The electrophoretic resist or patternable material can be post-develop treated with photostabilization techniques to render it generally insoluble in most organic solvents, such as alcohols used in the electrophorctic deposition of phosphors. Therefore, electrophoretic deposition of phosphor compositions can be performed. For example, such photostabilization techniques may include a deep ultraviolet plasma treatment of the patterned resist in an ozone plasma for about 1 minute to about 10 minutes, may include a hard bake of the electrophoretic resist at temperatures of about 100° C. to about 150° C. for about 2–15 minutes or more, preferably about 120° C. for about 5 minutes, or may include a combination thereof.

After the phosphor composition 52 has been deposited, the patterned layer 39, e.g., the patterned photoresist, is removed. The removal of the patterned layer 39 may be performed by any suitable process which removes the patterned layer 39 but does not attack or degrade the phosphor element 52 deposited in the openings 40. For example, the patterned layer 39 may be removed using an oxygen plasma, or a mixture of gases not detrimental to the phosphors. Further, the layer 39 may be removed using a thermal strip such as by subjecting the assembly to temperatures in the range of about 350° C. to about 700° C. in an oxygen environment. Yet further, and preferably, the patterned layer 39 may be removed using a wet stripper such as Microposit® Remover 1165 available from Shipley Company, Inc., or a stripper available under the trade designation ST22 Positive Resist Stripper from Advanced Chemical Systems Int'l., (Milpitas, Calif.), or any other etch solution containing n-methyl pyrrolidone.

It will be readily apparent to one skilled in the art that light emitting elements formed in the openings 40 may be formed using materials or compositions other than phosphor compositions. Further, various phosphor compositions are available for providing multiple colors. For example, compositions used for the light emitting elements may include $Y_2O_3$:Eu, ZnS:Ag, $Zn_2SiO_4$:Mn, ZnO:Zn,, or other doped rare earth metal oxides capable of providing luminescent characteristics. Such light emitting elements formed from such materials or compositions are generally nonconductive, although some materials, such as ZnO:Zn, may be conductive.

Further, generally, in accordance with the present invention, FIG. 2 illustrates the use of electrophoretically deposited photoresist for use in forming one or more different elements on a conductive surface, e.g., phosphor light emitting elements of one, two, three or more different colors, with or without projections extending therefrom. FIG. 2 shows a substrate assembly 70 including substrate layer 74 and conductive layer 72. As described previously, substrate layer 74 may be glass, and conductive layer 72 may be indium tin oxide. Optionally, in this general illustration, projections 76 (e.g., spacers) may be affixed and positioned substantially orthogonally to conductive layer 72. Further, as shown in FIG. 2, a black matrix material 78 has been deposited on the conductive coating 72 in addition to a first phosphor color light emitting element 80 which has been formed in a first color region 79 on the conductive coating 72.

FIG. 2 illustrates that even with one or more thin layers of nonconductive materials deposited on conductive surface 73 of conductive layer 72, electrophoretic patternable material can be electrophoretically deposited over such thin layers of nonconductive material in addition to being deposited on the conductive surface 73. For example, as shown in FIG. 2, the black matrix material 78 has a thickness of about 1500 Å to about 15 microns and the first color light emitting element 80 has a thickness of about 1 micron to about 15 microns. With the application of a suitable voltage differential using voltages 86 and 87 in the electrophoretic patternable material deposition system, generally represented as reference number 71, a uniform layer of patternable material 84 is deposited over the nonconductive thin layers, e.g., black matrix material 78 and first color phosphor light emitting material 80, in much the same manner as the patternable material 38 was deposited and patterned as described with reference to FIG. 1.

The thickness of the patternable material 84 which deposits over the nonconductive materials, e.g., material 78 and light emitting element 80, is generally less than the thickness of patternable material 84 that is deposited on conductive surface 73. Such formation of patternable material 84 over nonconductive thin materials occurs using electrophoretic processes having substantially equivalent parameters to that described with reference to FIG. 1. As shown in FIG. 2, with the patternable material 84 patterned to define opening 82 that is open to conductive surface 73, an additional and different material or composition may be formed in a second region, e.g., a second color region 81. Likewise, the deposition or formation of additional patterned material may be performed repetitively over thin nonconductive layers, structures, etc. in addition to forming on the conductive surface 73 for use in forming additional regions on conductive surface 73. For example, the additional regions may be used in forming third light emitting color elements in a third color region 83.

The maximum thickness of nonconductive material over which the patternable material 84 may be formed is about 15 microns. Preferably, the nonconductive material has a thickness of less than about 5 microns. For example, the patternable material 84 will deposit on nonconductive material, e.g., phosphors, having thicknesses less than about 15 microns. The maximum thickness for other materials such as black matrix material will generally be less than about 5 microns.

The thickness of the nonconductive material over which such patternable material will form using electrophoretic deposition is believed to depend on the porosity of the nonconductive material. It is believed that the thin nonconductive regions, e.g., phosphors, are porous, facilitating the reduction of $H_2O$ at their surface, which allows the resist micelles to be protonated and precipitate out of the solution and deposit throughout and onto the porous nonconductive regions. One of ordinary skill in the art will recognize that with application of a larger voltage differential in the electrophoretic bath between the electrode and the conductive layer 72, patternable material 84 may be deposited or formed on thicker nonconductive regions.

It will be recognized by one skilled in the art that the use of electrophoretically deposited photoresist in the formation of two or more color light emitting elements on a conductive surface of a face plate assembly requires the formation and patterning of resist over previously formed light emitting elements. Therefore, the present invention provides a beneficial process even when spacers 76, or other projections from a substrate assembly, are not necessary. For example, spacers 76 may not be needed in small area displays, as described in U.S. Pat. No. 5,486,126. Therefore, the use of electrophoretically deposited or formed patternable material is beneficial in cases where substrate assembly 70 does not include projections extending therefrom. A general process of forming a three-color display face plate will be described further below with reference to FIGS. 5 and 6.

Figure 3A:
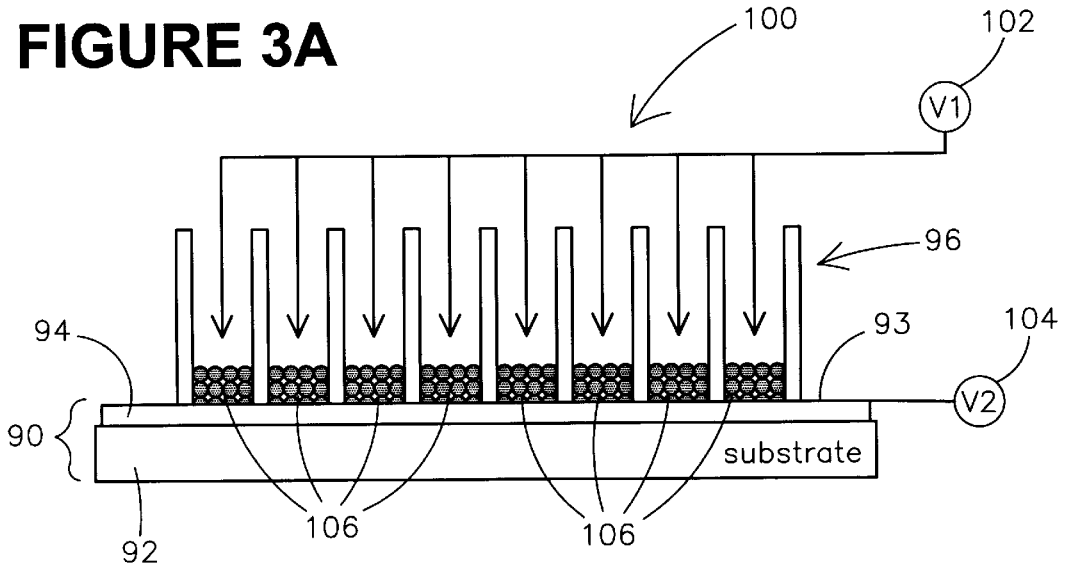
FIGS. 3A–3D illustrate the use of electrophoretically depositing a mixture of patternable material and light emitting material in the formation of light emitting elements on a conductive surface of a substrate assembly having projections or features extending therefrom.

There are various other techniques of using electrophoretically depositable photoresist according to the present invention. FIGS. 3A–3D show an alternative embodiment of using electrophoretic patternable material in the formation of light emitting elements (e.g., phosphor elements) on conductive surface 93 of a substrate assembly 90 including a substrate material 92 (e.g., glass) and a conductive layer 93 (e.g. indium tin oxide). The electrophoretic deposition system 100 includes structure for applying a differential voltage in an electrophoretic bath. For example, the differential voltage is provided by applying voltage 102 to an electrode of the electrophoretic bath and applying voltage 104 to conductive layer 93. A mixture 106 of patternable material and light emitting material, as shown in FIG. 3A, can then be deposited onto surface 93 using the electrophoretic process.

Figure 3B:
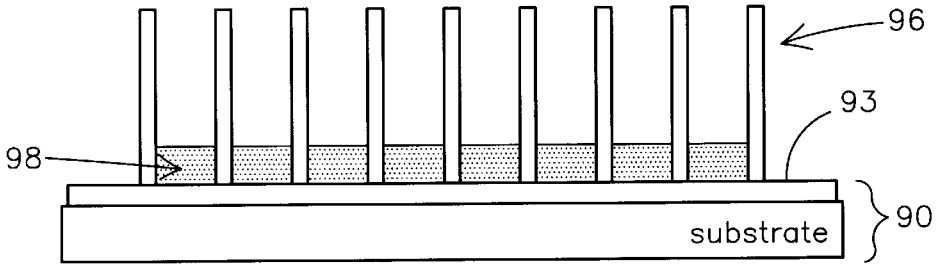

The mixture 106 of patternable material and light emitting material is then coalesced in a manner substantially similar to that described with reference to FIG. 1 to form a patternable layer 98 as shown in FIG. 3B. The patternable layer 98 is a uniform thin layer of the mixture on conductive surface 93 adjacent and between spacers 96 projecting from substrate assembly 90.

Figure 3C:
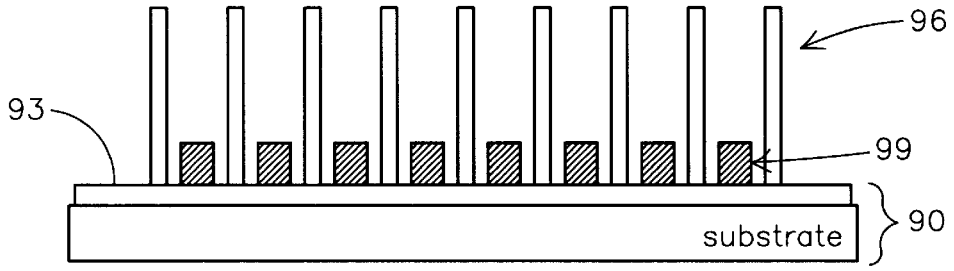

The patternable layer 98 is then patterned using photolithographic processes of a similar nature as that described with reference to FIG. 1, resulting in a patterned layer 99 of the mixture of light emitting material and patternable material as shown in FIG. 3C. The patterned layer 99 corresponds to the light emitting elements to be deposited on conductive surface 93.

Figure 3D:
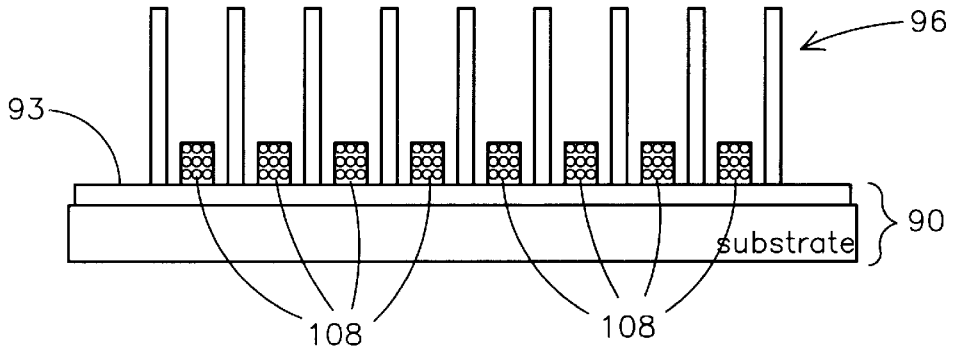

As shown in FIG. 3D, the patternable material of the mixture of patternable material and light emitting material is then stripped from the patterned layer 99, and the light emitting material is formed on conductive surface 93. Such removal of the patternable material is preferably performed by thermal stripping at temperatures of about 350° C. to about 700° C. in air. However, other patternable material removal techniques may be used, such as an oxygen ash. It may also be necessary to "anchor" the deposits of light emitting material by use of a binder material and/or aluminizing the screen prior to stripping by thermal methods.

Figure 4A:
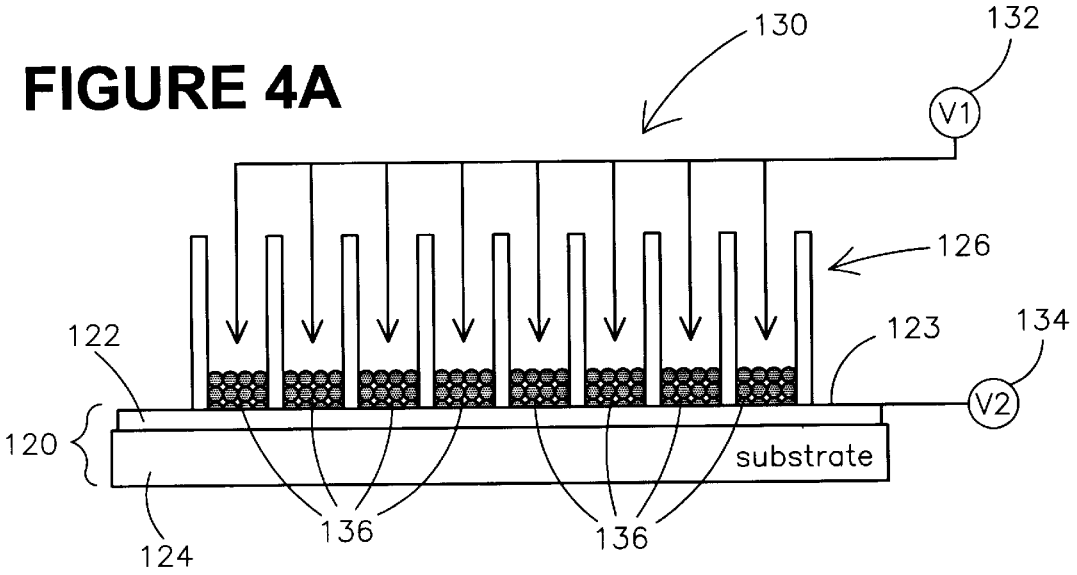
FIGS. 4A–4D illustrate electrophoretically depositing patternable material and using a tackification process for depositing light emitting elements on a conductive surface of a substrate assembly having projections extending therefrom.

FIGS. 4A–4D illustrate yet another alternative method of using electrophoretic patternable material in the formation of structures, e.g., phosphor elements, on a conductive surface 123. Shown in FIG. 4A is a substrate assembly 120 including a substrate layer 124 and a conductive layer 122 having conductive surface 123. Projections 126 extend from the substrate assembly in a substantially orthogonal manner. Patternable material 136 is electrophoretically deposited using an electrophoretic deposition system generally represented as reference numeral 130 using a voltage differential applied via voltage source 132 and voltage source 134. Such electrophoretic deposition of the patternable material 136 is substantially similar to the process described with reference to FIG. 1.

Figure 4B:
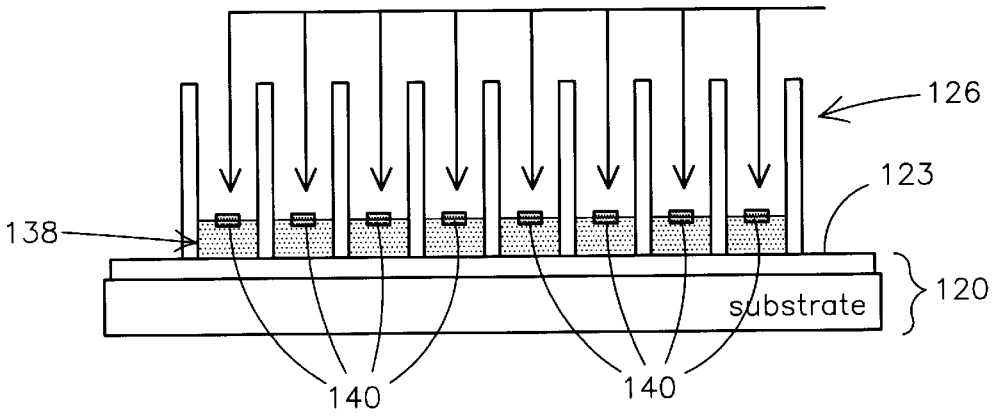

Further, as shown in FIG. 4B, the electrophoretically deposited patternable material 136 is coalesced to form a layer of material 138. This layer of patternable material 138 undergoes a tackification process wherein regions of the patternable layer 138 are tackified such that materials adhere thereto during subsequent processing, such as dusting. Such tackification, for example, is performed by exposure to radiation through a photomask, post-exposure baking, humidifying, or a combination of such techniques.

Figure 4C:
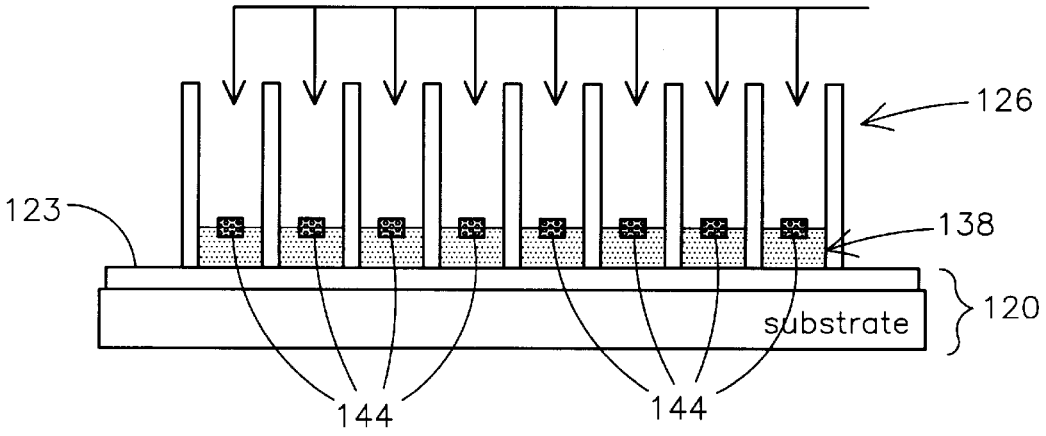
Figure 4D:
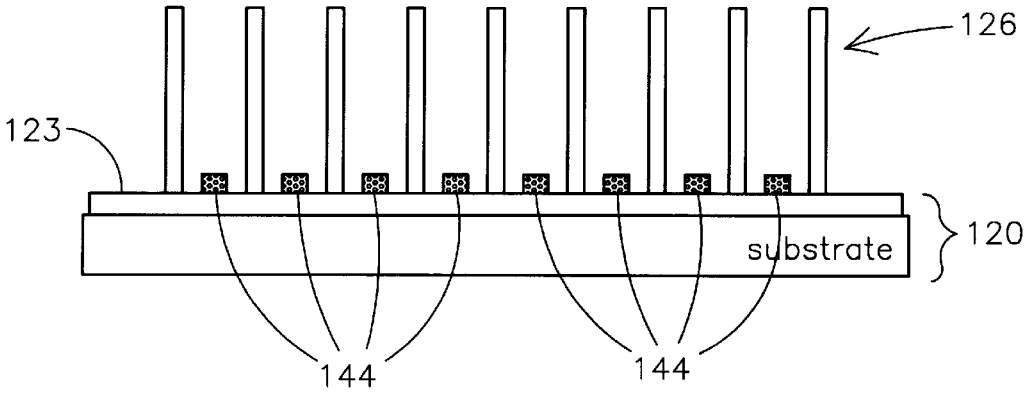

Light emitting material 144, e.g., phosphor composition, is then applied to the patternable layer 138 including tackified regions 140 with the light emitting material 144 adhering to the tackified regions 140, as shown in FIG. 4C. Excess light emitting material, e.g., phosphor composition, is removed leaving only the phosphor composition adhering in the tackified regions 140. The patternable layer 138 is then removed allowing the light emitting material 144 to form on conductive surface 123, as shown in FIG. 4D. Preferably, the patternable material is removed using a thermal stripping process such as at a temperature of about 350° C. to about 700° C. in an oxygen environment.

Referring to FIGS. 5A–5C and FIGS. 6A–6C, an illustrative embodiment of a portion of a field emission display employing a display segment 222 is shown.

For example, each display segment 222 is capable of displaying a pixel of information or a portion of a pixel as, for example, one green dot of a red/green/blue full color triad pixel. The portion of the display shown in FIG. 5A includes a face plate portion or structure 223 and a base plate portion or structure 221. With respect to the base plate portion 221, preferably, a doped silicon layer is used to form emission sites 213 on glass substrate 211. Alternatively, any other material capable of conducting electrical current can be used to form the emission sites 213.

The field emission sites 213 have been constructed on top of substrate 211. Each emission site 213 is a protuberance which may have a variety of shapes, such as pyramidal, conical, or any other geometry which has a fine micropoint for the emission of electrons. Surrounding the emission site 213 is a grid structure 215. When a voltage differential via source 220 is applied between the emission site 213 and the grid structure 215, a beam of electrons 217 is emitted toward light emitting material 219 coated on face plate structure 223. Dielectric insulating layer 214 is formed about the emission site 213. The dielectric insulating layer 214 also has an opening at the field emission site location.

The face plate structure 223 preferably includes a phosphor coated substrate assembly 216 including a substrate layer 230 and a conductive layer 231 having a conductive surface 232 as described previously herein with reference to other embodiments of the present invention. The face plate 223 serves as the anode of the display. Disposed between the face plate portion 223 and the base plate portion 221 are spacers 218 which function to support the atmospheric pressure which exists on the electrode face plate structure 223 and base plate structure 221 as a result of the vacuum which is created therebetween for the proper functioning of the emission sites 213.

It will be recognized by one skilled in the art that the spacers may, as previously described herein, include any number of pattern configurations, may themselves be of any size and configuration, and may be of any material suitable for such an application. The present invention is not limited to any particular spacer or feature projecting from the substrate assembly 216 of the face plate portion 223. Preferably, in accordance with the present invention, the spacers 218 are fixed to the substrate assembly 216 prior to the formation of the phosphor coated surface of the face plate portion 223. As described previously herein, the present invention is particularly beneficial for use in the deposition or formation of phosphor elements 219 formed on the conductive surface 232 of face plate portion 223 when projections 218 extend from the substrate assembly 216. As shown, such spacers 218 are of a length relatively large compared to the thickness of the phosphor coating 219.

Figure 5A:
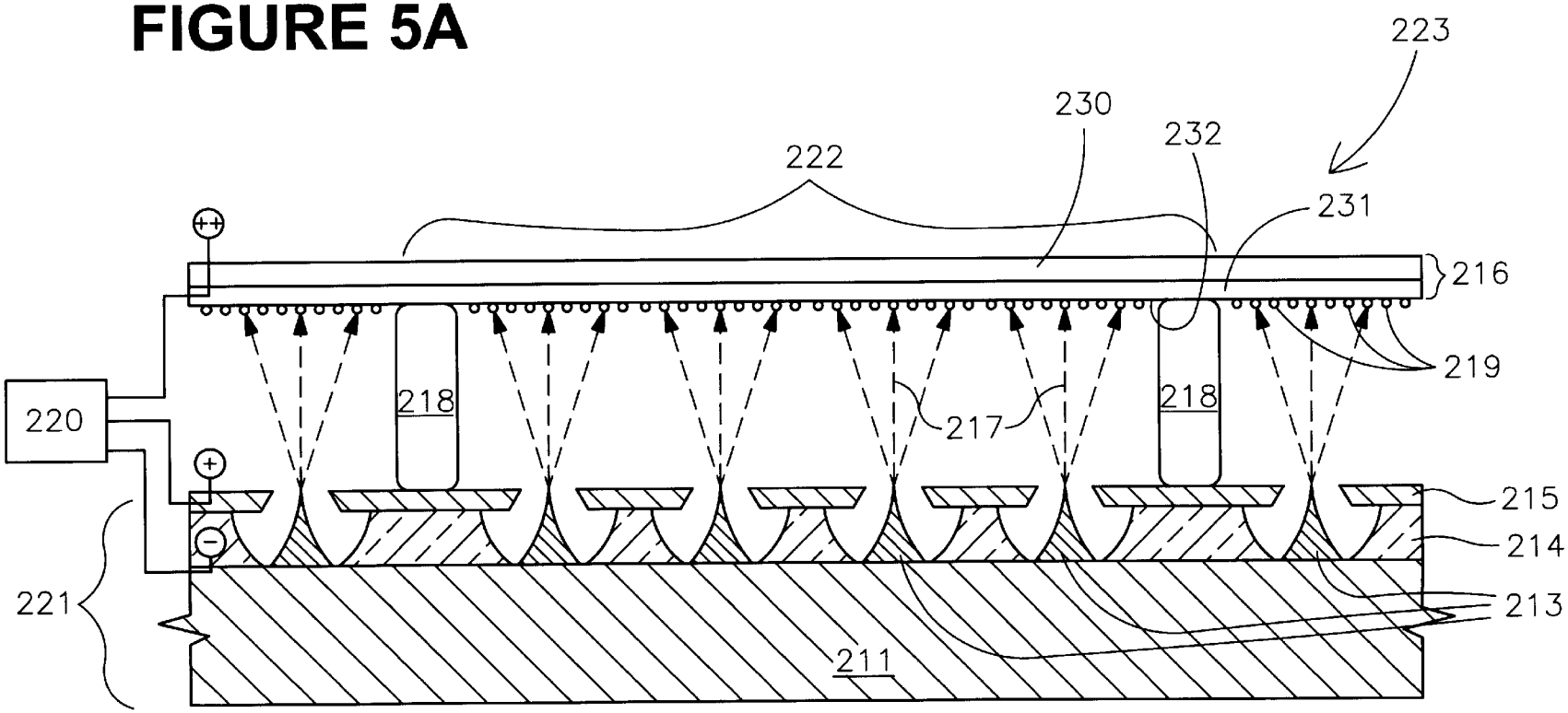
FIGS. 5A–5C show one illustrative embodiment of a portion of a field emission display having a face plate with projections extending therefrom according to the present invention.
Figure 5B:
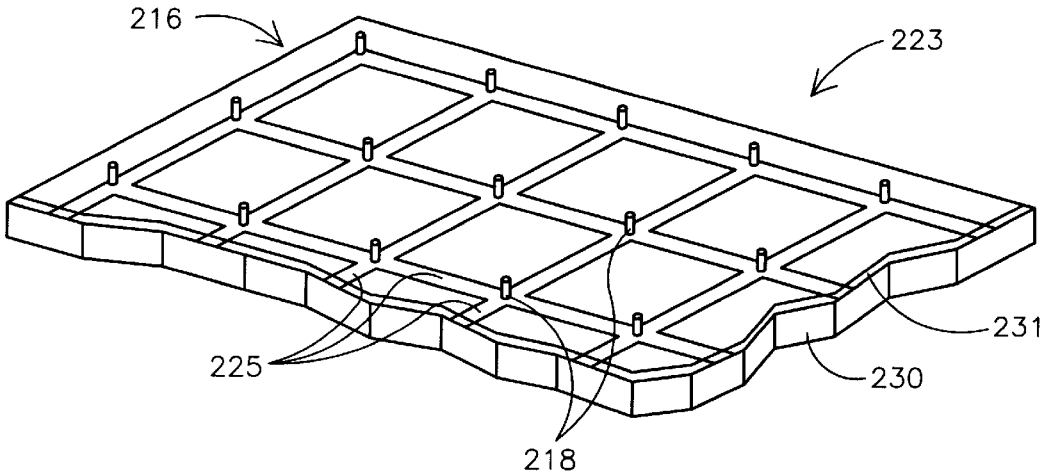

FIG. 5B shows a perspective cut-away of face plate portion 223 including substrate assembly 216 having spacers 218 formed and affixed thereto in a particular pattern. Further, black matrix material 225 is provided between the transparent conductive layer 231, e.g., indium tin oxide, and substrate layer 230, e.g., glass, of the substrate assembly 216.

Figure 5C:
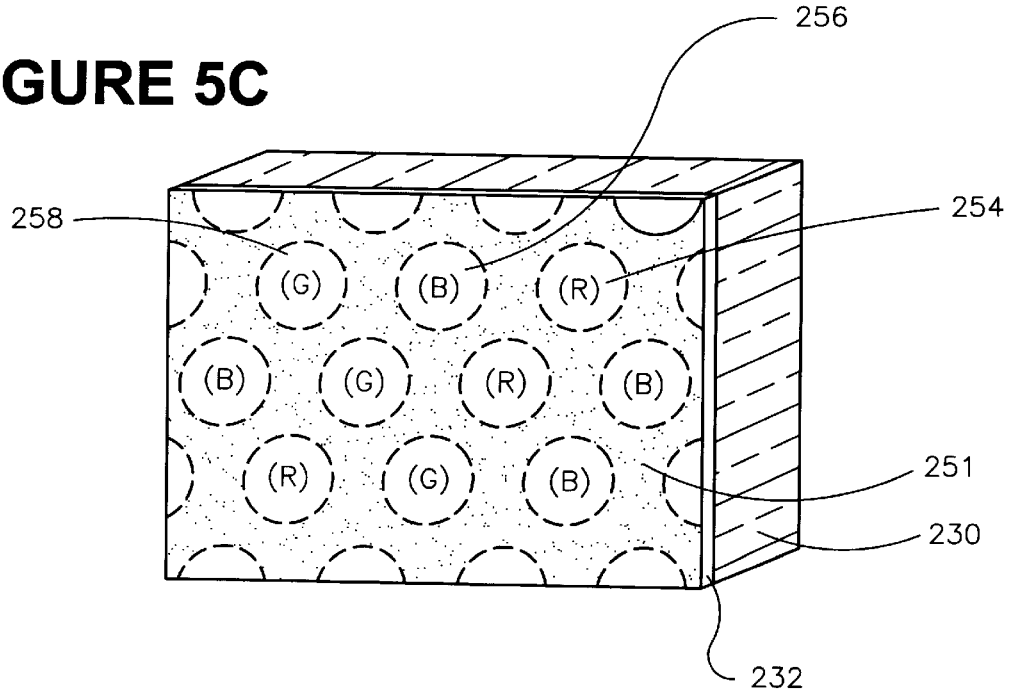

Further, as shown in FIG. 5C, the resulting structure of light emitting element formation or phosphor coating 219 is shown. The structure includes green light emitting elements 258, blue light emitting elements 256, and red light emitting elements 254 shown in the particular pattern formed on conductive layer 232 overlaying substrate layer 230. The black matrix layer 251 lies between the conductive layer 232 and substrate layer 230.

Figure 6A:
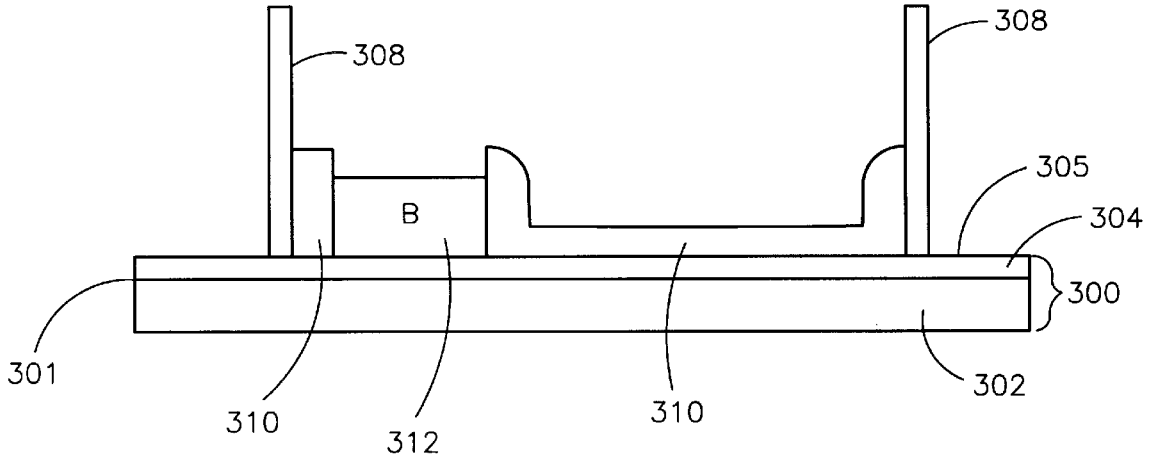
FIGS. 6A–6D are illustrations showing the use of electrophoretically deposited patternable material for color patterning of a face plate for a display.

One illustrative process of forming such three color light emitting elements as shown in FIGS. 5A–5C on a featured or spacered display face plate is illustrated and described below with reference to FIGS. 6A–6C. In this illustrative embodiment, the substrate assembly 300 includes a black matrix layer 301 for light blocking purposes sandwiched between conductive layer 304 (e.g., indium tin oxide layer) and substrate layer 302, e.g., glass substrate layer. Spacers 308 extend from the substrate assembly 300 in a substantially orthogonal manner from conductive surface 305 of conductive layer 304. First, blue phosphor elements 312 are deposited on conductive surface 305 of substrate assembly 300. To form such blue phosphor elements 312, the photoresist is electrophoretically deposited on conductive surface 305 and then patterned in a manner such as described previously with reference to FIG. 1. A phosphor composition is then formed in the opening defined by the patterned photoresist layer 310 to form blue phosphor element 312. Such a structure is shown in FIG. 6A.

Figure 6B:
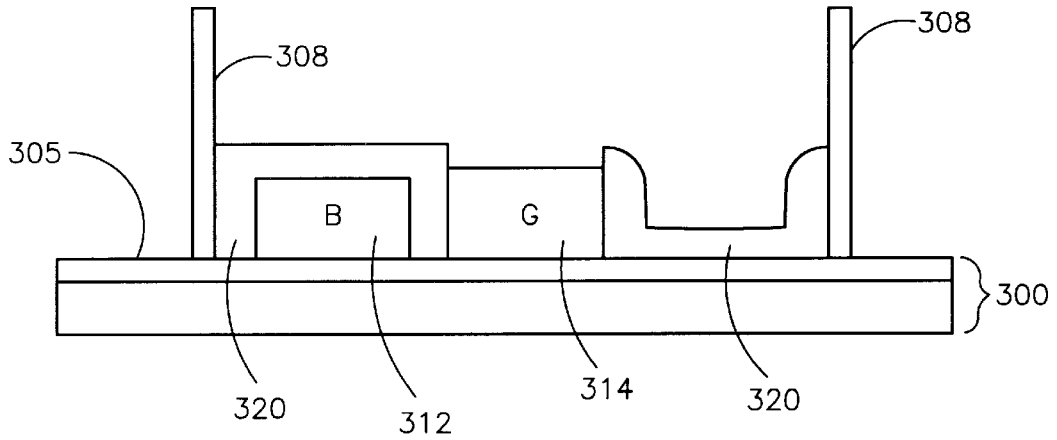

Thereafter, the photoresist 310 is removed, such as by an oxygen plasma strip, thermal strip, or wet organic stripper, and the structure precleaned for electrophoretically depositing and forming another patterned layer 320 of photoresist over the formed blue phosphor element 312 and the conductive surface 305, as shown in FIG. 6B in a manner as described previously with reference to FIGS. 1 and 2. Further, the patterned photoresist 320 defines an opening for the deposition or formation of a green phosphor light emitting element 314 therein. The structure resulting after the formation of the green phosphor light emitting element 314 is shown in FIG. 6B.

Figure 6C:
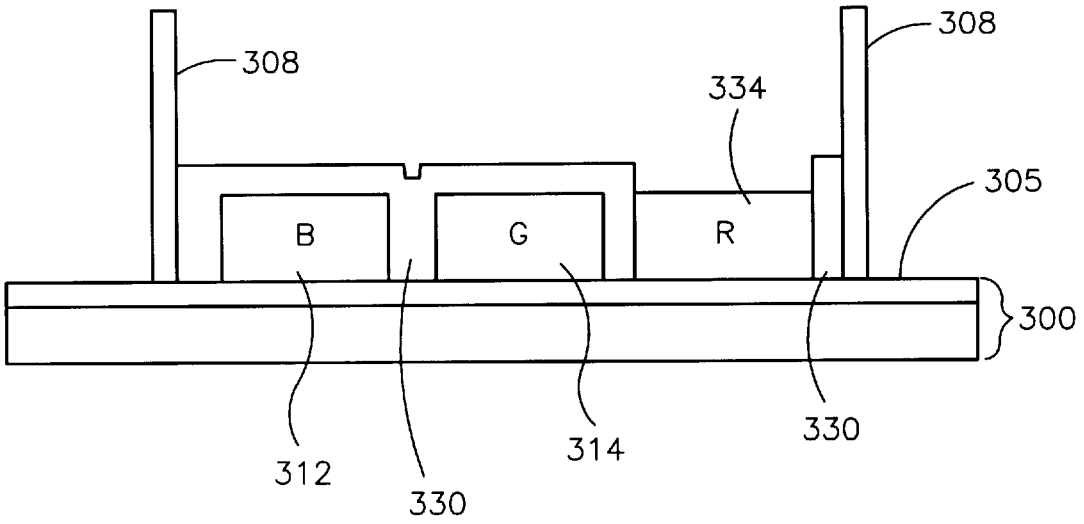
Figure 6D:
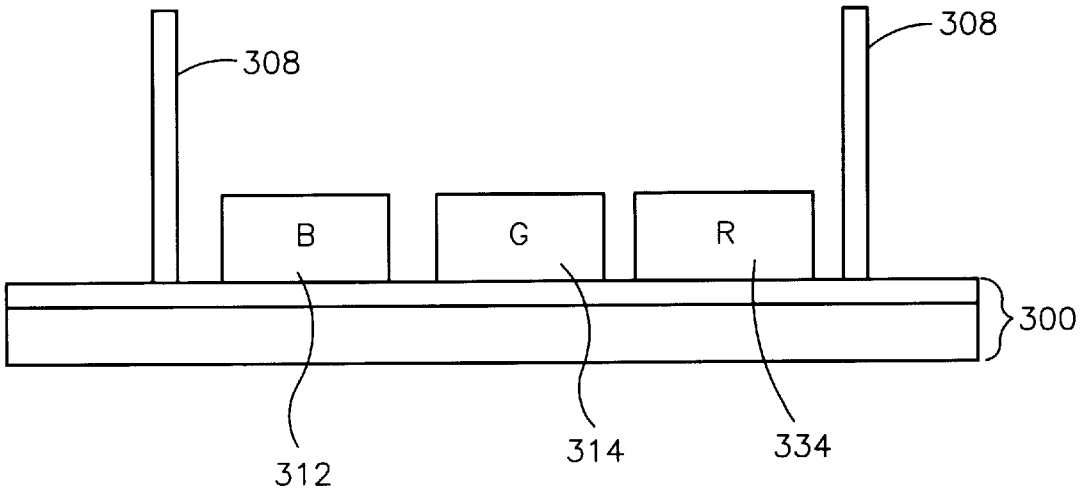

Thereafter, after stripping the photoresist 320 and precleaning the surfaces, another patterned layer 330 of photoresist is electrophoretically deposited over the blue phosphor light emitting element 312, green phosphor light emitting element 314 and the conductive surface 305, and then patterned to define an opening for the formation of a red phosphor light emitting element 334, as shown in FIG. 6C. After formation of the red phosphor light emitting element 334, using any process or technique for performing such deposition or formation, the photoresist 330 is stripped resulting in the three-color pattern display structure shown in FIG. 6D. Further, it should be readily apparent that the order of application of the color light emitting elements to the face plate may vary, e.g, blue then green then red, red then green then blue, etc.

One having ordinary skill in the art will realize that even though a field emission display was used as an illustrative example, the process is equally applicable to other displays (such as flat panel displays) and other devices requiring substrate assemblies having projections extending therefrom and for which one or more patterning steps need to be performed at the surface of such substrate assemblies. Further, various combinations of the techniques described herein may be used. For example, electrophoretic deposition of photoresist may be used in combination with electrophoretic deposition of phosphor elements or any other phosphor formation technique.

All patents or references cited herein are incorporated in their entirety as if each were incorporated separately. This invention has been described with reference to illustrative embodiments and is not meant to be construed in a limiting sense. Various modifications of the illustrative embodiments, as well as additional embodiments of the invention, will be apparent to persons skilled in the art upon reference to this description. It is therefore contemplated that the appended claims will cover any such modifications or embodiments as may fall within the scope of the present invention, as defined by the accompanying claims.

What is claimed is:

1. A method for use in the production of a face plate of a display, the method comprising:

providing a substrate assembly of the face plate of the display, the substrate assembly including a conductive surface at a first side of the assembly;

providing one or more projections extending from the first side of the substrate assembly;

electophoretically depositing a patternable material on the conductive surface and adjacent the projections; and patterning the patternable material resulting in a patterned layer defining openings therein for use in formation of one or more light emitting elements on the conductive surface.

2. The method of claim 1, wherein the one or more projections include a plurality of spacers extending from the first side of the substrate assembly.

3. The method of claim 1, wherein the method further includes:

forming one or more first color light emitting elements on the conductive surface through the defined openings in the patterned layer;

removing the patterned layer after the one or more first color light emitting elements are formed resulting in exposed regions of the conductive surface;

repeatedly electrophoretically depositing and patterning of patternable material and forming of light emitting elements on the conductive surface to form one or more additional light emitting elements of one or more additional colors on the conductive surface.

4. The method of claim 1, wherein the patternable material is an electrophoretic photoresist.

5. The method of claim 1, wherein the light emitting elements are phosphors.

6. The method of claim 1, wherein the one or more projections are nonconductive projections.

7. The method of claim 1, wherein the one or more projections include at least portions that are slightly conductive, the slightly conductive portions of the one or more projections further having patternable material electrophoretically deposited thereon.

8. A method for use in the production of a face plate of a display, the method comprising:

providing a substrate assembly of the face plate of the display, the substrate assembly including a conductive surface at a first side assembly;

providing one or more projections extending from the first side of the substrate assembly;

electrophoretically depositing a patternable material mixed with a light emitting material over the conductive surface and adjacent the projections; and patterning the patternable material mixed with light emitting material resulting in a patterned layer corresponding to one or more light emitting elements on the conductive surface.

9. The method of claim 8, wherein the one or more projections include a plurality of spacers extending from the first side of the substrate assembly.

10. The method of claim 8, wherein the method further includes removal of the patternable material of the electrophoretically deposited patternable material mixed with the light emitting material to form the one or more light emitting elements on the conductive surface.

11. The method of claim 10, wherein the method further includes repeatedly electrophoretically depositing and patterning of patternable material mixed with light emitting material on the conductive surface for use in forming one or more additional light emitting elements of one or more additional colors thereon.

12. The method of claim 8, wherein the patternable material is an electrophoretic photoresist.

13. The method of claim 8, wherein the light emitting elements are phosphors.

14. The method of claim 8, wherein the one or more projections are nonconductive projections.

15. The method of claim 8, wherein the one or more projections include at least portions that are slightly conductive, the slightly conductive portions of the one or more projections further leaving patternable material electrophoretically deposited thereon.

16. A method for use in the production of a face plate of a display, the method comprising:

providing a substrate assembly of the face plate of the display the substrate assembly including a conductive surface at a first side of the assembly;

providing one or more projections extending from the first side of the substrate assembly;

electrophoretically depositing a patternable material on the conductive surface and adjacent the projections; and patterning the patternable material by tackifying one or more surface regions of the deposited patternable material.

17. The method of claim 16, wherein the one or more projections include a plurality of spacers extending from the first side of the substrate assembly.

18. The method of claim 16, wherein the method further includes applying light emitting material to the tackified one or more surface regions of the deposited patternable material and removing the electrophoretically deposited patternable material to form the one or more light emitting elements on the conductive surface.

19. The method of claim 18, wherein the method further includes repeatedly tackifying one or more surface regions of the patternable material, applying light emitting material on the tackified surface regions to form one or more additional light emitting elements of one or more additional colors on the conductive surface.

20. The method of claim 16, wherein the one or more projections are nonconductive projections.

21. The method of claim 16, wherein the one or more projections include at least portions that are slightly conductive, the slightly conductive portions of the one or more projections further having patternable material electrophoretically deposited thereon.

* * * * *

UNITED STATES PATENT AND TRADEMARK OFFICE

CERTIFICATE OF CORRECTION

PATENT NO. : 6,153,075
DATED : November 28, 2000
INVENTOR(S) : Nemelka

It is certified that error appears in the above-identified patent and that said Letters Patent is hereby corrected as shown below:

Column 1,
After the title of the application, please insert,

-- GOVERNMENT RIGHTS

This invention was made with United States Government support under Contract No. DABT63-97--C--0001 awarded by the Advanced Research Projects Agency (ARPA). The United States Government has certain rights in this invention. --;

At U.S. Patent Documents, please delete "5,634,858 6/1997 Stansbury" and insert -- 5,634,585 6/1997 Stansbury --;

Column 11,
Line 26, please delete "electrophorctic" and insert -- electrophoretic --;

Column 18,
Line 12, please insert -- , -- after "display".

Signed and Sealed this

First Day of January, 2002

*Attest:*

*Attesting Officer*

JAMES E. ROGAN
*Director of the United States Patent and Trademark Office*